US010005610B2

(12) United States Patent
Jacobs

(10) Patent No.: US 10,005,610 B2
(45) Date of Patent: Jun. 26, 2018

(54) SPRAY CAP WITH ACTUATOR FOR AEROSOL CAN

(71) Applicant: Michael Jacobs, Johnsburg, IL (US)

(72) Inventor: Michael Jacobs, Johnsburg, IL (US)

(73) Assignee: Pro Form Products Ltd., Milton, Ontario (CA)

( * ) Notice: Subject to any disclaimer, the term of this patent is extended or adjusted under 35 U.S.C. 154(b) by 58 days.

(21) Appl. No.: 15/139,973

(22) Filed: Apr. 27, 2016

(65) Prior Publication Data

US 2016/0311605 A1 Oct. 27, 2016

Related U.S. Application Data

(60) Provisional application No. 62/153,098, filed on Apr. 27, 2015.

(51) Int. Cl.

| | |
|---|---|
| ***B65D 83/00*** | (2006.01) |
| ***B65D 83/20*** | (2006.01) |
| ***B65D 83/40*** | (2006.01) |
| ***B65D 83/14*** | (2006.01) |
| *B05B 15/62* | (2018.01) |
| *B05B 15/25* | (2018.01) |

(52) U.S. Cl.

CPC ..... *B65D 83/205* (2013.01); *B65D 83/20* (2013.01); *B65D 83/40* (2013.01); *B65D 83/7532* (2013.01); *B05B 15/25* (2018.02); *B05B 15/62* (2018.02)

(58) Field of Classification Search

CPC ..... B65D 83/205; B65D 83/20; B65D 83/40; B65D 83/7532; B65D 83/28

USPC ..... 222/538, 402.13; 215/227

See application file for complete search history.

(56) References Cited

U.S. PATENT DOCUMENTS

| | | | | |
|---|---|---|---|---|
| 3,191,809 A * | 6/1965 | Schultz | B65D 83/20 | 222/182 |
| 3,407,975 A * | 10/1968 | Schroeder | B65D 83/205 | 222/402.13 |
| 3,881,638 A * | 5/1975 | Grothoff | B65D 83/40 | 220/266 |
| 4,728,007 A * | 3/1988 | Samuelson | B65D 51/242 | 222/182 |
| 5,711,484 A * | 1/1998 | Blette | B05B 1/34 | 222/109 |
| 6,325,256 B1 * | 12/2001 | Liljeqvist | B65D 83/201 | 222/151 |
| 8,550,382 B2 * | 10/2013 | Heatley | B65D 83/303 | 239/303 |
| 8,746,585 B2 * | 6/2014 | Harwood | F04B 1/146 | 222/333 |

(Continued)

*Primary Examiner* — Jeremy W Carroll

(74) *Attorney, Agent, or Firm* — Fay Sharpe LLP; James E. Scarbrough

(57) ABSTRACT

A spray cap for use with an aerosol can having a body having a recessed area; and an actuator button removably stored on the recessed area in an opening formed in the recessed area. The recessed area is resilient and flexible to accommodate inserting and removing the actuator. The actuator has a top wall which is curved and ergonomically configured to receive a user's finger. The actuator comprises an opening for dispensing paint or other liquid. The recessed area has flanges on opposite sides of the opening to facilitate insertion and removal of the actuator thereon.

9 Claims, 3 Drawing Sheets

(56) References Cited

U.S. PATENT DOCUMENTS

| | | | | |
|---|---|---|---|---|
| 2004/0089676 | A1* | 5/2004 | Greer, Jr. ..... | B65D 83/303<br>222/538 |
| 2008/0296416 | A1* | 12/2008 | Goulet ..... | B65D 83/40<br>239/600 |
| 2017/0029200 | A1* | 2/2017 | Park ..... | B65D 83/205 |

* cited by examiner (EXISTING)

SPRAY CAP WITH ACTUATOR FOR AEROSOL CAN

CLAIM OF PRIORITY

This application claims priority from U.S. Provisional Application Ser. No. 62/153,098 filed on Apr. 27, 2015, the entirety of which is hereby incorporated by reference.

BACKGROUND OF THE DISCLOSURE

The present disclosure relates to a spray cap for an aerosol can. More particularly, it relates to a spray cap which can have a spray head or actuator built into or removably installed on the cap.

Existing caps for aerosol cans typically serve to only cover or enclose the spray head of an aerosol can. That is, the actuator is part of the can itself and is not provided with the spray cap.

There is a need to be able to change the size of the paint spray that is released from a spray head of an aerosol can. Existing spray heads can generate a fan of paint spray of about six or seven inches. This size of spray works well for painting a door or a larger area such as a wall. However, if the user would like to spray paint a much smaller area, such as a rod, then the existing spray heads would generate a lot of wasted paint, as well as possibly result in paint contacting other areas not requiring paint. Thus, by providing an aerosol spray cap which has a separate or built-in actuator, a second or alternate actuator can be used with the spray can which provides a smaller or different spray fan from the actuator of the can itself.

Thus, there is also a need to provide a spray cap which provides a removably installed or built-in actuator which can be installed onto a variety of aerosol cans to incorporate an extra nozzle or actuator in addition to the actuator provided on the aerosol can itself. There is a need for a spray cap with an actuator which overcomes the above mentioned difficulty and others while providing better and more advantageous overall results.

SUMMARY OF THE DISCLOSURE

The present disclosure relates to a spray cap for an aerosol can. More particularly, it relates to a spray cap which can have a spray head or actuator built into or removably installed on the cap. Currently, aerosol spray cans are provided for paint or adhesive aerosol spray. The spray cans have only one actuator which is provided with the can itself. The present disclosure provides a spray cap which provides a second or additional aerosol actuator which can replace the actuator on the can or be used in addition to the actuator on the can. The second actuator can provide a different spray pattern from the actuator of the aerosol can. The end user can then choose either of the two aerosol actuators; that is the actuator that is provided with the cap or the actuator on the can itself. The cap provides the method for displaying, retaining, and using the second actuator in a user friendly manner.

In accordance with one embodiment of the disclosure, a spray cap for use with an aerosol can has a body having a recessed area; and an actuator button removably stored on the recessed area in an opening formed in the recessed area. The recessed area can be resilient and flexible to accommodate inserting and removing the actuator. The actuator has a top wall which is curved and ergonomically configured to receive a user's finger. The actuator has an opening for dispensing paint or other liquid. The recessed area has flanges on opposite sides of the opening to facilitate insertion and removal of the actuator.

In accordance with a preferred embodiment of the disclosure, a spray cap typically used with an aerosol spray can has a spray head actuator button which is used and stored with the spray cap.

In accordance with another embodiment of the disclosure, the actuator is inserted into a recessed area of the cap and inserted into hole in a bottom wall of the area. Recessed area can be slightly resilient or flexible to accommodate the actuator and installing and removing the actuator.

In accordance with another embodiment of the disclosure, the spray head or actuator can have a curved or rounded top wall which is ergonomic and receives a user's finger, and has a slot or opening through which the paint is sprayed outwardly into a fan. The actuator operates to actuate the release of a paint spray in a conventional manner well known in the art. The actuator can spray paint or other liquid in a fan range of less than one inch to more than seven inches.

In accordance with another aspect of the disclosure, on either side of the recess are curved or angled or sloped flanges or ledges which facilitate easy installation and removal of the actuator from the cap.

In yet another embodiment of the disclosure, described is a spray cap and aerosol can arrangement comprising: an aerosol can having a first actuator; a spray cap on which is mounted a second actuator; a valve and dip tube within a body of said aerosol can; a propellant and a product which is dispersed by said can; and a mixing member to facilitate mixing of said propellant and said product.

Still other embodiments of the disclosure will become apparent upon a reading and understanding of the following detailed description.

BRIEF DESCRIPTION OF THE DRAWINGS

The disclosure may take form in various parts and arrangements of parts. The drawings are only for purposes of illustrating a preferred embodiment and are not to be construed as limiting the disclosure.

DETAILED DESCRIPTION OF THE DISCLOSURE

Currently, aerosol spray cans are provided for paint or adhesive aerosol spray. The spray cans have only one actuator which is provided with the can itself. The present disclosure provides a spray cap which provides a second or additional aerosol actuator which can replace the actuator on the can or be used in addition to the actuator on the can. The second actuator can provide a different spray pattern from the actuator of the aerosol can. The end user can then choose either of the two aerosol actuators; that is the actuator that is provided with the cap or the actuator on the can itself. The cap provides the method for displaying, retaining, and using the second actuator in a user friendly manner.

Figure 1:
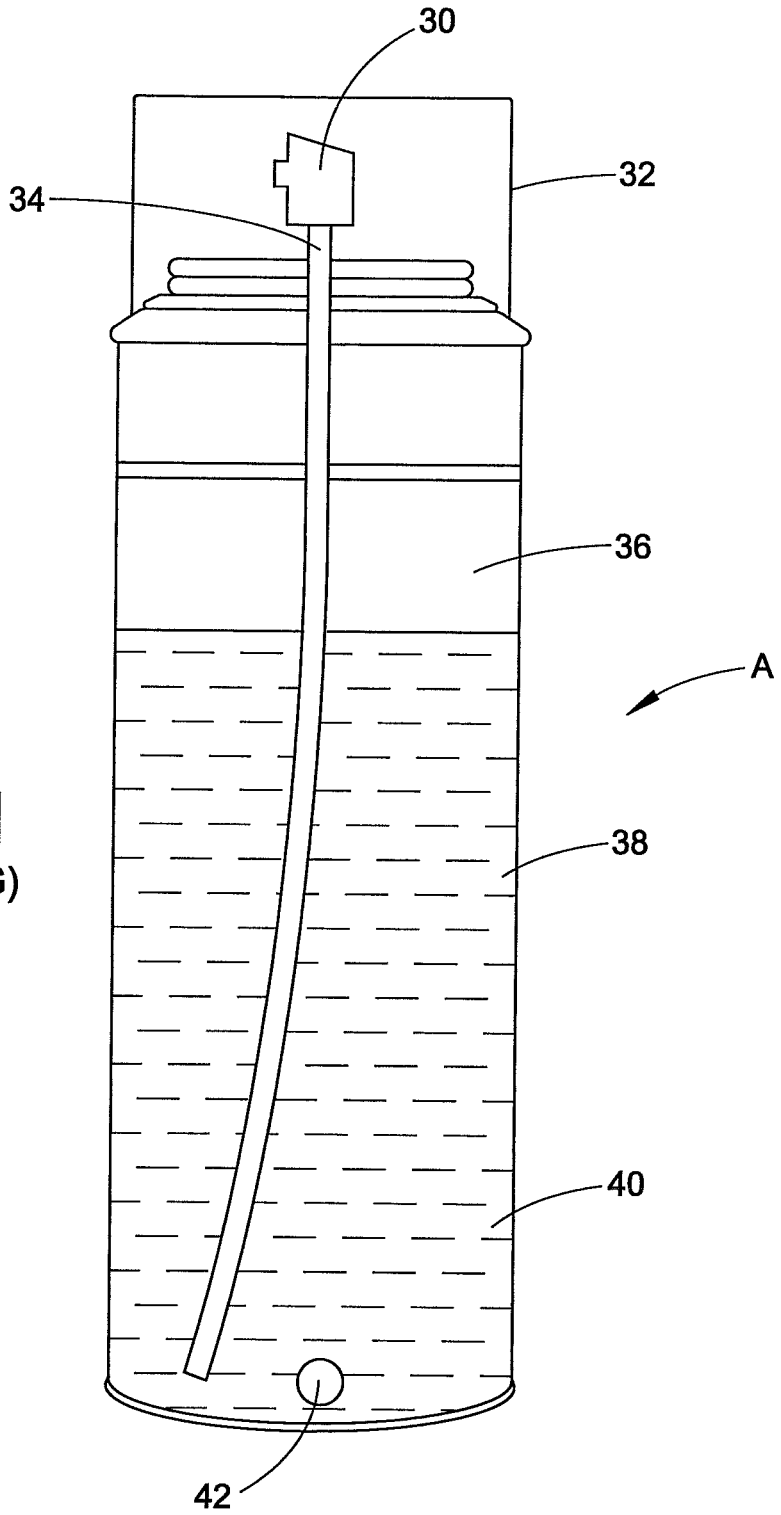
FIG. 1 is a side elevational view of an existing aerosol can and cap.

Referring now to FIG. 1, an existing aerosol can A typically has seven main components: a sprayhead (actuator) 30; a cap 32; a valve and dip tube 34; a propellant 36; a product or coating 38 such as paint, a gel, an adhesive or an epoxy; a can body 40 and a mixing ball 42 (which rattles when shaken). The propellant drives the product or coating out through the valve at the top of the can at a pressure of about 50 to 60 lbs. Aerosol cans are typically supplied in various sizes such as 4-ounce, 6-ounce, 8-ounce, 12-ounce, 16-ounce, 20-ounce, 24-ounce and 32-ounce sizes.

Figure 2:
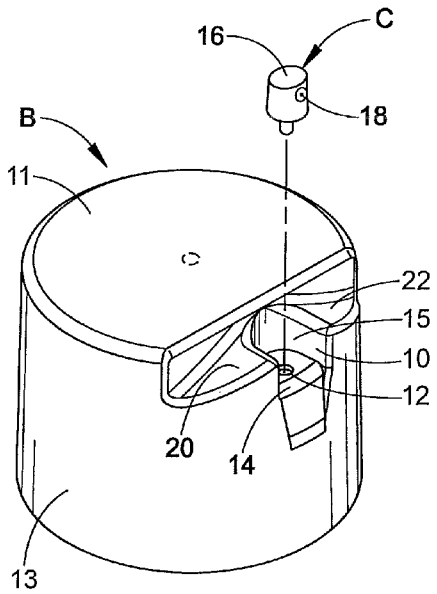
FIG. 2 is an exploded perspective view of a spray cap and actuator in accordance with a preferred embodiment of the disclosure.
Figure 3:
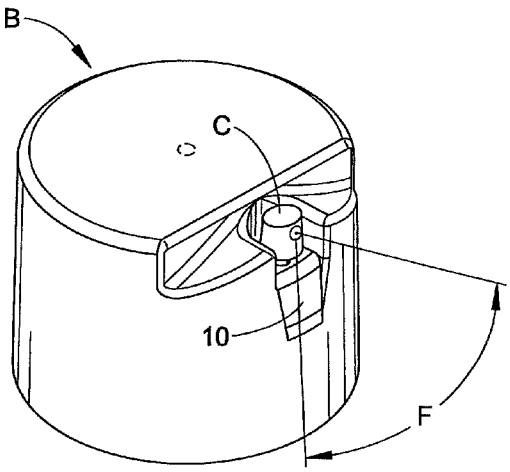
FIG. 3 is a perspective view of the spray cap and actuator of FIG. 2 in an assembled configuration.
Figure 4:
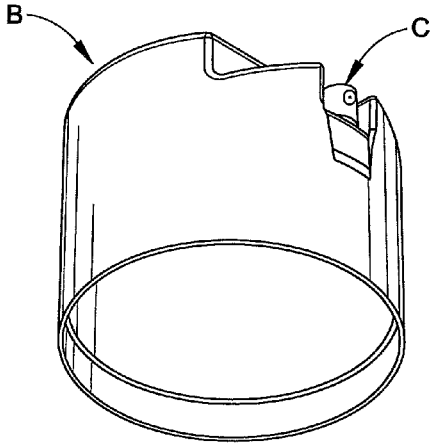
FIG. 4 is a bottom perspective view of the spray cap.
Figure 5:
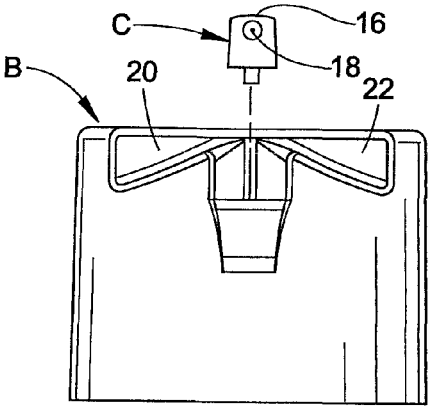
FIG. 5 is a front elevational exploded view of spray cap and actuator in accordance with the present disclosure.
Figure 6:
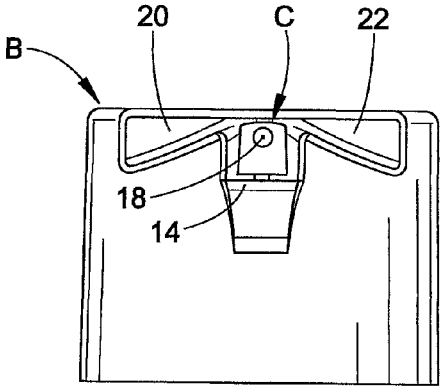
FIG. 6 is a front elevational view of the spray cap and actuator of FIG. 5 in an assembled configuration.
Figure 7:
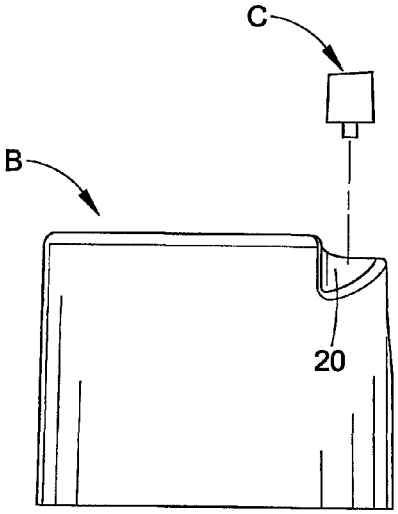
FIG. 7 is an exploded side elevational view of the fill spray cap and actuator.
Figure 8:
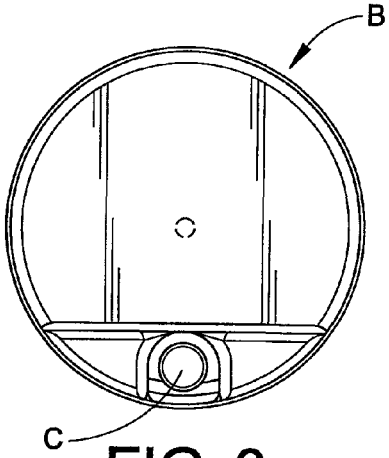
FIG. 8 is a top plan view of the spray cap and actuator of the preferred embodiment.
Figure 9:
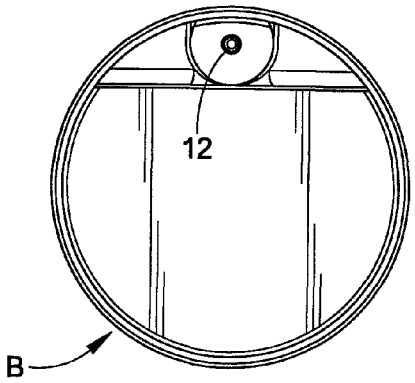
FIG. 9 is a bottom plan view of the spray cap.

Referring now to FIGS. 2-9, in accordance with a preferred embodiment of the disclosure, a spray cap B typically used with an aerosol spray can is shown with a spray head actuator button C which is used and stored with the spray cap. FIGS. 2 and 7 show a perspective view of the spray head actuator C removed from the aerosol cap B, while FIG. 3 shows a perspective view of the spray head actuator C is an installed position on cap B. FIG. 4 illustrates a bottom perspective view and FIG. 9 illustrates a bottom plan view of the cap itself.

In accordance with a preferred embodiment of the disclosure, in FIG. 2, the cap B has a body having a top wall 11, side wall 13 and a recessed side wall 15 formed in a recessed area 10. The actuator C is inserted into recessed area 10 of the cap and inserted into hole 12 in a bottom wall 14 of the area 10. Recessed area 10 can be slightly resilient or flexible to accommodate the actuator and installing and removing the actuator.

The spray head or actuator C can have a curved or rounded top wall 16 which is ergonomic and receives a user's finger, and has a slot or opening 18 through which the paint is sprayed outwardly into a fan arrangement. The fan F (FIG. 3) can vary widely in width, but in range from less than one inch in width to greater than seven inches in width. The actuator C operates to actuate the release of a paint spray in a conventional manner well known in the art.

On either side of the recess 10 are curved or angled or sloped flanges or ledges 20, 22 which facilitate easy installation and removal of the actuator C from the cap B.

In storage, the actuator C is inserted into the hole 12 of the recess 10 of cap B as clearly seen in FIGS. 3, 6, and 8. To remove the actuator C, it is simply pulled out of the hole 12 of cap B as seen in FIGS. 2, 5, and 7. The actuator 30 of the can A is then removed and is replaced by actuator C which is placed on tube 34. Alternatively, the actuator 30 of the can A could be removed and the actuator C could be directly connected to the valve and dip tube 34 and retained on the cap itself such that the actuator C can be used while still installed on the cap B. Then the actuator C is depressed while on the cap B in an installed configuration.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or equivalents thereof.

The invention claimed is:

1. A spray cap for use with an aerosol can, comprising:

a body having a top wall, a side wall and a substantially u-shaped recessed area formed between a pair of flanges which are curved upwardly toward said recessed area; said recessed area comprises a recessed area side wall extending below said flanges and a bottom wall formed below said recessed area side wall, said bottom wall comprising an opening; and an actuator removably stored in said recessed area in said opening formed in said bottom wall of said recessed area; wherein said actuator is removed and mounted on said aerosol can after a second actuator is removed.

2. The spray cap of claim 1, wherein said recessed area is resilient and flexible to accommodate inserting and removing said actuator.

3. The spray can of claim 1, wherein said actuator comprises a top wall which is curved and ergonomically configured to receive a user's finger.

4. The spray cap of claim 1, wherein said actuator comprises an opening for dispensing paint or other liquid.

5. The spray cap of claim 1, wherein said actuator dispenses liquid in a fan range of one to seven inches wide.

6. The spray cap of claim 1, wherein said flanges of said recessed area are sloped to facilitate insertion and removal of said actuator.

7. The spray cap of claim 1, wherein said flanges are curved to facilitate insertion and removal of said actuator.

8. The spray cap of claim 1, wherein said flanges are angled to facilitate insertion and removal of said actuator.

9. The spray cap of claim 1, wherein said actuator is removed from said cap and is inserted on a dip tube of said aerosol can after an actuator on said can is removed.

* * * * *